US010388237B2

(12) United States Patent
Zeng

(10) Patent No.: US 10,388,237 B2
(45) Date of Patent: Aug. 20, 2019

(54) GOA DRIVE UNIT AND DRIVE CIRCUIT

(71) Applicant: Shenzhen China Star Optoelectronics Technology Co., Ltd., Shenzhen, Guangdong (CN)

(72) Inventor: Mian Zeng, Guangdong (CN)

(73) Assignee: SHENZHEN CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 336 days.

(21) Appl. No.: 15/324,698

(22) PCT Filed: Nov. 29, 2016

(86) PCT No.: PCT/CN2016/107603
§ 371 (c)(1),
(2) Date: Jan. 7, 2017

(87) PCT Pub. No.: WO2018/040322
PCT Pub. Date: Mar. 8, 2018

(65) Prior Publication Data

US 2018/0190223 A1 Jul. 5, 2018

(30) Foreign Application Priority Data

Aug. 31, 2016 (CN) ..... 2016 1 0793464

(51) Int. Cl.
*G09G 3/36* (2006.01)

(52) U.S. Cl.
CPC ..... *G09G 3/3648* (2013.01); *G09G 3/3674* (2013.01); *G09G 3/3677* (2013.01); *G09G 2310/0286* (2013.01)

(58) Field of Classification Search
CPC .. G09G 3/3648; G09G 3/3677; G09G 3/3674; G09G 3/3696; G09G 2310/0286;
(Continued)

(56) References Cited

U.S. PATENT DOCUMENTS 6,845,140 B2 * 1/2005 Moon ..... G09G 3/3685 345/100
7,283,603 B1 * 10/2007 Chien ..... G11C 19/00 345/100

(Continued)

OTHER PUBLICATIONS

*International Search Report* dated Jun. 6, 2017, from related international application No. PCT/CN2016/107603.

(Continued)

*Primary Examiner* — Christopher E Leiby

(57) ABSTRACT

Disclosed is a GOA drive unit and drive circuit. The GOA drive unit includes a first pull-down transistor, a second pull-down transistor, a third pull-down transistor, a fourth pull-down transistor, a fifth pull-down transistor that is configured to maintain a low voltage at gate electrodes of the first pull-down transistor and the third pull-down transistor, and a sixth pull-down transistor that is configured to maintain a low voltage at gate electrodes of the second pull-down transistor and the fourth pull-down transistor. The drive unit can reliably stabilize a voltage on a critical circuit node in a circuit.

8 Claims, 4 Drawing Sheets

(58) Field of Classification Search
CPC ... G09G 2300/0809; G09G 2300/0842; G09G 2300/0408; G11C 19/287; H03K 3/012; H01L 27/1225; H01L 29/7869
See application file for complete search history.

(56) References Cited

U.S. PATENT DOCUMENTS

| | | | | |
|---|---|---|---|---|
| 7,310,402 | B2 * | 12/2007 | Wei | G11C 19/28 377/64 |
| 7,590,214 | B2 * | 9/2009 | Liu | G11C 19/184 377/64 |
| 7,949,086 | B2 * | 5/2011 | Tsai | G11C 19/28 377/64 |
| 8,019,039 | B1 * | 9/2011 | Tsai | G11C 19/28 377/64 |
| 8,098,792 | B2 * | 1/2012 | Hsu | G09G 3/3677 377/64 |
| 8,331,524 | B2 * | 12/2012 | Hsu | G11C 19/00 377/64 |
| 8,395,612 | B2 * | 3/2013 | Liu | G09G 3/3677 345/205 |
| 8,396,183 | B2 * | 3/2013 | Yang | G09G 3/20 377/64 |
| 8,503,601 | B2 * | 8/2013 | Wang | G11C 19/28 377/64 |
| 8,971,479 | B2 * | 3/2015 | Chang | G09G 3/3655 377/64 |
| 9,105,347 | B2 * | 8/2015 | Su | G11C 19/28 |
| 9,383,841 | B2 * | 7/2016 | Lin | G06F 3/041 |
| 9,407,260 | B2 * | 8/2016 | Xiao | G09G 3/3655 |
| 9,483,992 | B2 * | 11/2016 | Xiao | G09G 3/3677 |
| 9,552,788 | B2 * | 1/2017 | Xiao | G09G 3/3648 |
| 9,576,524 | B2 * | 2/2017 | Kim | G11C 19/28 |
| 9,793,005 | B2 * | 10/2017 | Xiao | G11C 19/184 |
| 2003/0189542 | A1 * | 10/2003 | Lee | G09G 3/3648 345/93 |
| 2003/0210220 | A1 | 11/2003 | Hebiguchi | |
| 2006/0017685 | A1 * | 1/2006 | Tseng | G11C 19/00 345/100 |
| 2006/0284815 | A1 * | 12/2006 | Kwon | G09G 3/3614 345/98 |
| 2007/0035505 | A1 | 2/2007 | Lin et al. | |
| 2008/0056431 | A1 * | 3/2008 | Chien | G09G 3/20 377/79 |
| 2011/0150169 | A1 | 6/2011 | Lin et al. | |
| 2014/0168044 | A1 | 6/2014 | Hu et al. | |
| 2016/0260405 | A1 | 9/2016 | Dai | |
| 2016/0275895 | A1 | 9/2016 | Dai | |
| 2016/0284304 | A1 | 9/2016 | Dai | |
| 2016/0343332 | A1 | 11/2016 | Cao | |
| 2016/0343334 | A1 | 11/2016 | Hao | |

OTHER PUBLICATIONS

Office Action dated Mar. 7, 2018 from related Chinese patent application No. 201610796434.1.

* cited by examiner

GOA DRIVE UNIT AND DRIVE CIRCUIT

CROSS-REFERENCE TO RELATED APPLICATIONS

The present application claims the priority of Chinese patent application CN 201610793464.1, entitled "GOA drive unit and drive circuit" and filed on Aug. 31, 2016, the entirety of which is incorporated herein by reference.

FIELD OF THE INVENTION

The present disclosure relates to the field of liquid crystal displays, and in particular, to a GOA drive unit and drive circuit.

BACKGROUND OF THE INVENTION

A drive circuit of a conventional liquid crystal display device is generally in the form of an externally attached integrated circuit module, such as the commonly used tape automated bonding (TAB) package structure. However, with the development of low temperature poly silicon (LTPS) semiconductor thin-film transistors that have ultrahigh carrier mobility, the integrated circuit technology based on panel peripherals gradually becomes a focus of researches. A typical application in this respect is the gate driver on array (GOA) technology.

A GOA drive circuit uses a liquid crystal display array process to manufacture a gate scanning drive signal circuit on an array substrate, so as to drive scanning on pixel units gate by gate. The GOA drive circuit can reduce soldering operations for connecting an external integrated circuit and improve integration, and can also improve productivity and reduce production costs, and therefore is a preferred choice for small- and medium-sized liquid crystal display products (such as mobile phones and PDAs). In addition, with increasing acceleration of a smart-up process of mobile phones, corresponding technical support is required for the touch control technology applied to small- and medium-sized liquid crystal display devices. Therefore, more requirements are imposed on drive circuits.

The GOA drive circuit in the prior art has the following problems. On the one hand, parameters of a transistor are greatly distributed, and performance of the transistor may be affected after long-time working, further causing changes of the parameters. As a result, voltages on some critical circuit nodes in the drive circuit may change. This may cause a failure of a designed time sequence and function in a severe case, and further cause a failure of the entire GOA drive circuit. On the other hand, in a process of manufacturing the GOA drive circuit, faults, such as short circuits or open circuits, easily occur due to reasons such as a large quantity of circuit poles or a large quantity of transistors. In addition, repair difficulty is high. As a result, once such a fault occurs, a liquid crystal panel becomes a defective product, severely affecting a yield rate of liquid crystal panels.

SUMMARY OF THE INVENTION

One of the technical problems to be solved by the present disclosure is to provide an improved GOA drive circuit, so as to stabilize a voltage of a critical circuit node and prevent a failure caused by a parameter change of a component.

In order to solve the above technical problem, an embodiment of the present application first provides a GOA drive unit, which includes a pull-up part, a pull-up control part, a key pull-down part, a pull-down holding part, and a boost capacitor. The pull-down holding part includes a mirrored circuit structure connected through a source and a drain that are of a bridge transistor. The mirrored circuit structure includes: a first pull-down transistor and a second pull-down transistor that are configured to maintain a low voltage at a control signal input end of the pull-up part, a third pull-down transistor and a fourth pull-down transistor that are configured to maintain a low voltage at a gate scanning signal output end of the pull-up part, a fifth pull-down transistor that is configured to maintain a low voltage at gate electrodes of the first pull-down transistor and the third pull-down transistor, and a sixth pull-down transistor that is configured to maintain a low voltage at gate electrodes of the second pull-down transistor and the fourth pull-down transistor. A drain of the fifth pull-down transistor is coupled with the gate electrodes of the first pull-down transistor and the third pull-down transistor, a drain of the sixth pull-down transistor is coupled with the gate electrodes of the second pull-down transistor and the fourth pull-down transistor, and gate electrodes of the fifth pull-down transistor and the sixth pull-down transistor are coupled together at the control signal input end of the pull-up part. Sources of all the pull-down transistors are coupled at a first pull-down voltage.

Preferably, the sources of the fifth pull-down transistor and the sixth pull-down transistor are coupled at a second pull-down voltage. The second pull-down voltage is less than the first pull-down voltage.

Preferably, drains of the first pull-down transistor and the second pull-down transistor are coupled together at the control signal input end of the pull-up part, and drains of the third pull-down transistor and the fourth pull-down transistor are coupled together at the gate scanning signal output end of the pull-up part.

Preferably, the mirrored circuit structure further includes a first alternate control circuit and a second alternate control circuit that are mirrored. The first alternate control circuit includes: a seventh transistor, where a gate electrode and a drain of the seventh transistor are coupled together and are configured to receive a first alternate control signal; an eighth transistor, where a gate electrode and a drain of the eighth transistor are coupled with a source and the drain of the seventh transistor respectively; a ninth transistor, where a drain and a source of the ninth transistor are coupled with the drain and a source of the eighth transistor respectively, and a gate electrode of the ninth transistor is configured to receive a second alternate control signal; and a tenth transistor, where a drain of the tenth transistor is coupled with the gate electrode of the eighth transistor, and a gate electrode and a source of the tenth transistor are coupled with a gate electrode and a source of the fifth pull-down transistor respectively. The second alternate control circuit has a mirrored structure of the first alternate control circuit, and input ends of a first alternate control signal and a second alternate control signal of the second alternate control circuit are interchanged. The first alternate control signal and the second alternate control signal are high and low alternately.

Preferably, a frequency of the alternate control signal is less than a frequency of a scanning clock signal of the GOA drive unit.

Preferably, a download element is further included. The download element includes a download transistor. A gate electrode of the download transistor is coupled with the control signal input end of the pull-up part. A drain of the download transistor is coupled with a clock signal input end of the pull-up part. A source of the download transistor generates a download signal that acts on a next-level GOA drive unit.

In another aspect, a GOA drive circuit is further provided. The GOA drive circuit formed by the foregoing GOA drive unit by cascading inputs, into each GOA drive unit by means of interlacing, two scanning clock signals that have an equal frequency and reverse phases.

An embodiment of the present application further provides another GOA drive unit, such as the foregoing GOA drive unit, excluding the bridge transistor.

Preferably, a download element is further included. The download element includes a download transistor. A gate electrode of the download transistor is coupled with the control signal input end of the pull-up part. A drain of the download transistor is coupled with a clock signal input end of the pull-up part. A source of the download transistor is configured to generate a download signal that acts on a next-level GOA drive unit.

In another aspect, another GOA drive circuit is further provided. The GOA drive circuit formed by the foregoing GOA drive unit by cascading inputs, into each GOA drive unit by means of interlacing, two scanning clock signals that have an equal frequency and reverse phases.

Compared with the prior art, one or more embodiments in the above solutions have the following advantages or beneficial effects.

By optimizing the circuit structure of the GOA drive unit, the voltage of the critical circuit node in the circuit can be reliably stabilized, whereby the signal output capability of the circuit can be improved. In addition, the GOA drive unit has a specific self-repair capability. This can further improve a GOA panel yield rate and GOA panel display quality.

Other advantages, objectives, and features of the present disclosure will be further explained in the following description to some extent, and will become self-evident to persons skilled in the art to some extent based on study and research on the following context, or enlightenment can be obtained from practices of the present disclosure. The objectives and advantages of the present disclosure will be achieved through the structure specifically pointed out in the following description, claims, and the accompanying drawings.

BRIEF DESCRIPTION OF THE DRAWINGS

The drawings are provided for further understanding of the technical solutions of the present application or the prior art, and constitute one part of the description. The drawings illustrating the embodiments of the present application serve to explain the technical solutions of the present application in conjunction with the embodiments of the present application, rather than to limit the technical solutions of the present application in any manner. In the drawings.

DETAILED DESCRIPTION OF THE EMBODIMENTS

The following describes the implementation manners of the present disclosure in detail in conjunction with the accompanying drawings and embodiments, so that one can fully understand the implementation process in the present disclosure of solving a technical problem using technical means and achieving corresponding technical effects, thereby implementing the present disclosure. As long as there is no conflict, the embodiments of the present application as well as the respective features in the embodiments may be combined with one another, and the formed technical solutions fall within the protection scope of the present disclosure.

Figure 1:
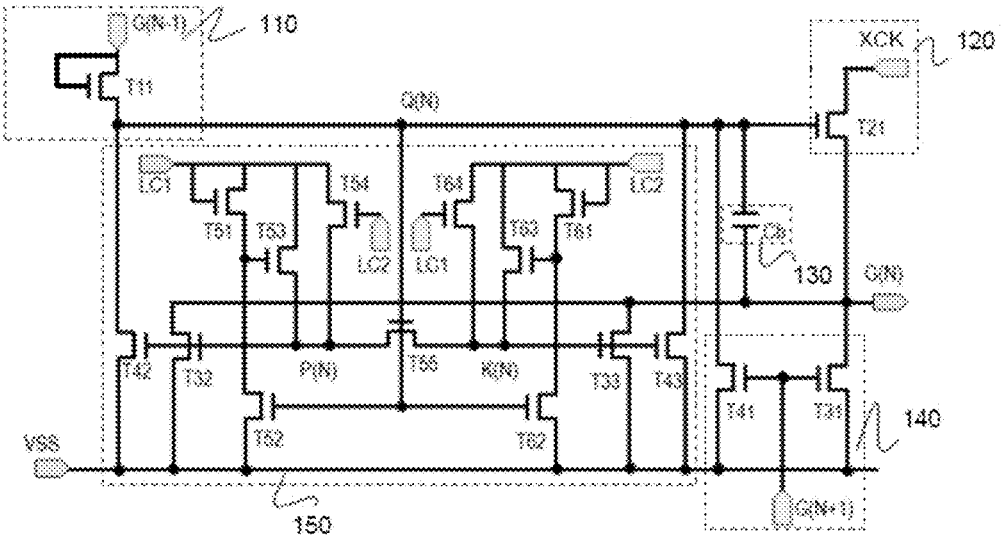
FIG. 1 schematically shows a structure of a GOA drive unit in the prior art.

A GOA drive circuit in the prior art generally includes multiple GOA drive units that are cascaded. Each level of GOA drive unit correspondingly drives a respective level of horizontal gate scanning line. FIG. 1 schematically shows a structure of a GOA drive unit in the prior art. As shown in the figure, the GOA drive unit mainly includes a pull-up control part 110, a pull-up part 120, a key pull-down part 140, a pull-down holding part 150, and a boost capacitor 130.

The pull-down holding part 150 is a circuit that has a mirrored structure. When a transistor is imposed to an effect of DC signals for a long time, a DC stress is generated, and performance of the transistor is affected, causing a failure of the transistor. The mirrored circuit can reduce an impact of the DC stress caused by the effect of the DC signals. However, critical circuit nodes P (N) and K (N) in the mirrored circuit are subject to a problem of voltage instability (which is described in detail below). This may cause a failure of the circuit. The present disclosure provides a GOA drive unit improved based on the foregoing basic structure, and the drive unit has a self-repair capability. Detailed descriptions are provided below in conjunction with specific embodiments.

Figure 2:
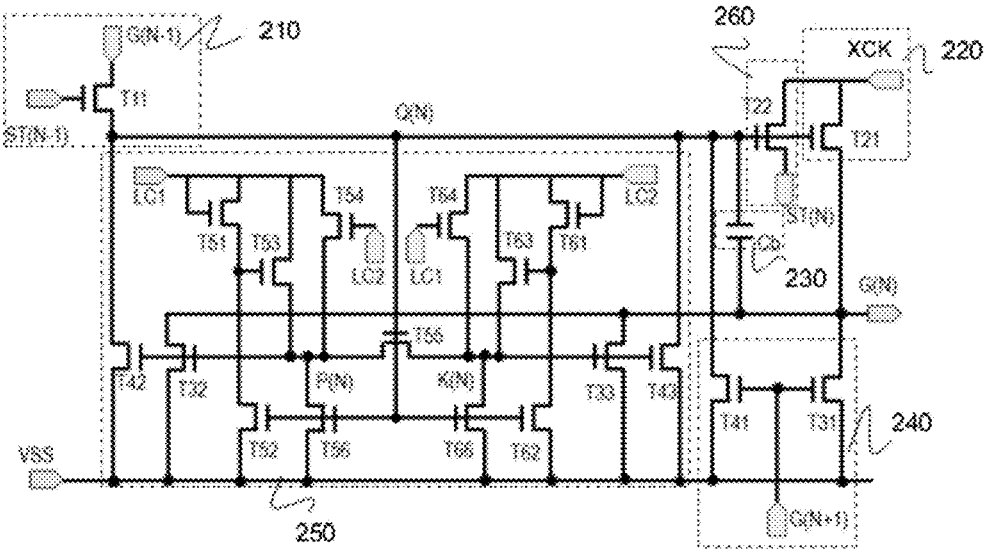
FIG. 2 schematically shows a structure of a GOA drive unit according to an embodiment of the present disclosure.

FIG. 2 schematically shows a structure of a GOA drive unit according to an embodiment of the present disclosure. As shown in the figure, an $N^{th}$-level GOA drive unit controls charging on an $N^{th}$-gate horizontal scanning line G (N) in a display area, and includes a pull-up control part 210, a pull-up part 220, a boost capacitor 230, a key pull-down part 240, a pull-down holding part 250, and a download element 260.

Specifically, the pull-up control part 210 is mainly configured to control a start time of the pull-up part 220, to implement scanning on a liquid crystal panel gate by gate. The pull-up control part 210 may be formed by a pull-up control transistor T11. It can be seen from FIG. 2 that, a gate electrode of the pull-up control transistor T11 receives an ST (N−1) signal. The signal is a download signal generated by a preceding-level (the $(N-1)^{th}$ level) GOA drive unit.

In the prior art (as shown in FIG. 1), a preceding-level output signal, that is, a gate scanning signal G (N−1), is generally applied to start a next-level drive unit. A drain and the gate electrode of the pull-up control transistor T11 are coupled together and receive the gate scanning signal output by the preceding-level GOA drive unit. A source of the pull-up control transistor T11 generates a scanning control signal that acts on a control signal input end of the pull-up part. In this case, T11 is equivalent to a diode, that is, a gate-source voltage of T11 Vgs=0. There is a relatively large drain current inside T11.

In this embodiment of the present disclosure, the download element 260 is added. As shown in FIG. 2, the download element 260 is mainly formed by a download transistor T22. A gate electrode and a drain of the download transistor T22 are connected to the pull-up part 220. The gate electrode of T22 is coupled with the control signal input end of the pull-up part 220. The drain of T22 is coupled with a clock signal input end of the pull-up part 220. A source of T22 generates and outputs a download signal ST (N), which acts on a gate electrode of a pull-up control transistor T11 of a next-level (the $(N+1)^{th}$ level) GOA drive unit. A drain and a source of T11 are connected to an $(N-1)^{th}$-level horizontal scanning line G (N−1) and an $N^{th}$-level Q (N) point respectively. A low potential of the download signal ST (N−1) is a low level of a clock signal CK (or XCK) and is generally −8 V. A low potential of the gate scanning signal G (N−1) is VSS and is generally −6 V, that is, the gate-source voltage of T11 Vgs<0. Therefore, by adding the download element 260, an electric leakage at a current-level Q point in a case of maintaining can be reduced.

Under an effect of the download signal ST (N−1) and the gate scanning output signal G (N−1) that are generated by the preceding-level drive unit, the pull-up control part 210 generates a scanning control signal Q (N). The scanning control signal Q (N) is responsible for a correct working time sequence of the entire GOA drive unit. When gate scanning proceeds to the $N^{th}$ level, Q (N) is a high level and may be used to start the pull-up part 220 to output a gate scanning signal. When the $N^{th}$ level is in a non-gate scanning state, it needs to be ensured that Q (N) is a reliable low level, so that the pull-up part 220 generates no output. Therefore, in design of the GOA drive unit and the drive circuit, it must be ensured that a time sequence of Q (N) is correct.

The pull-up part 220 is mainly responsible for outputting a scanning clock signal as a gate scanning signal at a gate electrode. As shown in FIG. 2, the pull-up part 220 may be formed by a pull-up transistor T21. A gate electrode of the pull-up transistor T21 serves as a control signal input end of the pull-up part 220 and receives a scanning control signal Q (N) that is generated by the pull-up control part 210. A drain of T21 serves as a clock signal input end of the pull-up part 220 and receives a scanning clock signal XCK. A source of T21 serves as a gate scanning signal output end of the pull-up part 220, connects the $N^{th}$-gate horizontal scanning line G (N), and generates and outputs a gate scanning signal G (N).

In addition, 230 in FIG. 2 is a boost capacitor. The boost capacitor acts to store voltages at the gate and source ends of the pull-up transistor T21 when Q (N) is a high level. After G (N) outputs a high-level gate scanning signal, the boost capacitor may boost a potential at the gate electrode of the pull-up transistor T21 for a second time, to ensure that the pull-up transistor T21 reliably starts and outputs a gate scanning signal. After a scanning time sequence of a current gate is completed, G (N) outputs a low level and is held at this low level when scanning is performed on another gate.

The key pull-down part 240 is configured to pull a potential at the source of the pull-up transistor T21 and the potential at the gate electrode of the pull-up transistor T21 down to a low potential, that is, disable the gate scanning signal G (N). As shown in FIG. 2, the key pull-down part 240 includes a pull-down transistor T31 and a pull-down transistor T41. T31 is configured to pull down a potential of the gate scanning signal G (N). A drain of T31 is coupled with a gate scanning signal output end of the pull-up part 220, that is, acts on the $N^{th}$-gate horizontal scanning line. T41 is configured to pull down the scanning control signal Q (N), so as to disable the pull-up transistor T21. A drain of T41 is coupled with the control signal input end of the pull-up part 220. Gate electrodes of T31 and T41 are coupled together and connected to an $(N+1)^{th}$-gate horizontal scanning line G (N+1), that is, to receive a gate scanning signal G (N+1) of a next-level GOA drive unit. A valid gate scanning signal of a next gate controls disabling of a gate scanning signal of a current gate, to implement scanning gate by gate. Sources of T31 and T41 are coupled together at a DC low level VSS.

After the next-level gate scanning signal G (N+1) returns to a low level, a low level cannot be held at G (N) and Q (N). Therefore, in the GOA drive unit, the pull-down holding part 250 is applied to maintain G (N) and Q (N) in a disabled state (that is, a negative potential).

As shown in FIG. 2, the mirrored circuit structure in the pull-down holding part 250 is connected through a bridge transistor T55. Specifically, a source (or a drain) of T55 is coupled with a mirrored circuit structure on the left at the P (N) point, and the drain (or the source) of T55 is coupled with a mirrored circuit structure on the right at the K (N) point. The circuit structures on the left and right are symmetric relative to T55 in a mirrored manner. A gate electrode of T55 is connected to the control signal input end of the pull-up part 220, that is, is controlled by the scanning control signal Q (N). During working, the mirrored circuit structures on the left and right work alternately, thereby effectively reducing a time in which the transistor is imposed to the effect of the DC signals, reducing the impact of the DC stress, avoiding the transistor failure caused by the DC stress, and improving reliability of the entire GOA drive unit (the GOA drive circuit).

As shown in FIG. 2, the mirrored circuit structure includes a first pull-down transistor T42 and a second pull-down transistor T43. A gate electrode of T42 is coupled with the source (or the drain) of T55. A gate electrode of T43 is coupled with the drain (or the source) of T55. Drains of T42 and T43 are coupled together at the control signal input end of the pull-up part 220 and are configured to maintain a disabled-state voltage at the control signal input end of the pull-up part 220. The mirrored circuit structure further includes a third pull-down transistor T32 and a fourth pull-down transistor T33. A gate electrode of T32 is coupled with the source (or the drain) of T55. A gate electrode of T33 is coupled with the drain (or the source) of T55. Drains of T32 and T33 are coupled together at the gate scanning signal output end of the pull-up part 220 and are configured to maintain a disabled-state voltage at the gate scanning signal output end of the pull-up part 220.

Further, as shown in FIG. 2, the mirrored circuit structure includes: a fifth pull-down transistor T56 that is configured to maintain disabled-state voltages at the gate electrodes of the first pull-down transistor T42 and the third pull-down transistor T32; and a sixth pull-down transistor T66 that is configured to maintain disabled-state voltages at the gate electrodes of the second pull-down transistor T43 and the fourth pull-down transistor T33. A drain of the fifth pull-down transistor T56 is coupled with the gate electrodes of the first pull-down transistor T42 and the third pull-down transistor T32. A drain of the sixth pull-down transistor T66 is coupled with the gate electrodes of the second pull-down transistor T43 and the fourth pull-down transistor T33. Gate electrodes of T56 and T66 are coupled together at the control signal input end of the pull-up part 220, that is, are controlled by the scanning control signal Q (N). Sources of all the pull-down transistors are coupled at a first pull-down voltage, that is, a DC low voltage VSS.

A first alternate control circuit and a second alternate control circuit coordinate alternate working of the two mirrored circuit structures. As shown in FIG. 2, the first alternate control circuit includes: a transistor T51, where a gate electrode and a drain of the transistor T51 are coupled together and are configured to receive a first alternate control signal LC1; a transistor T53, where a gate electrode and a drain of the transistor T53 are coupled with a source and the drain of the transistor T51 respectively; a transistor T54, where a drain and a source of the transistor T54 are coupled with the drain and a source of the transistor T53 respectively, and a gate electrode of the transistor T54 is configured to receive a second alternate control signal LC2; and a transistor T52, where a drain of the transistor T52 is coupled with the gate electrode of the transistor T53, and a gate electrode and a source of the transistor T52 are coupled with the gate electrode and a source of the pull-down transistor T56 respectively.

The second alternate control circuit has a mirrored structure of the first alternate control circuit, and details are not repeatedly described herein. Input ends of a first alternate control signal and a second alternate control signal of the second alternate control circuit are interchanged, as shown in FIG. 2.

The first alternate control signal LC1 and the second alternate control signal LC2 are high and low alternately, to control the alternate working of the mirrored circuit structures. The foregoing working process is described below in conjunction with a working time sequence diagram in FIG. 2.

Figure 3:
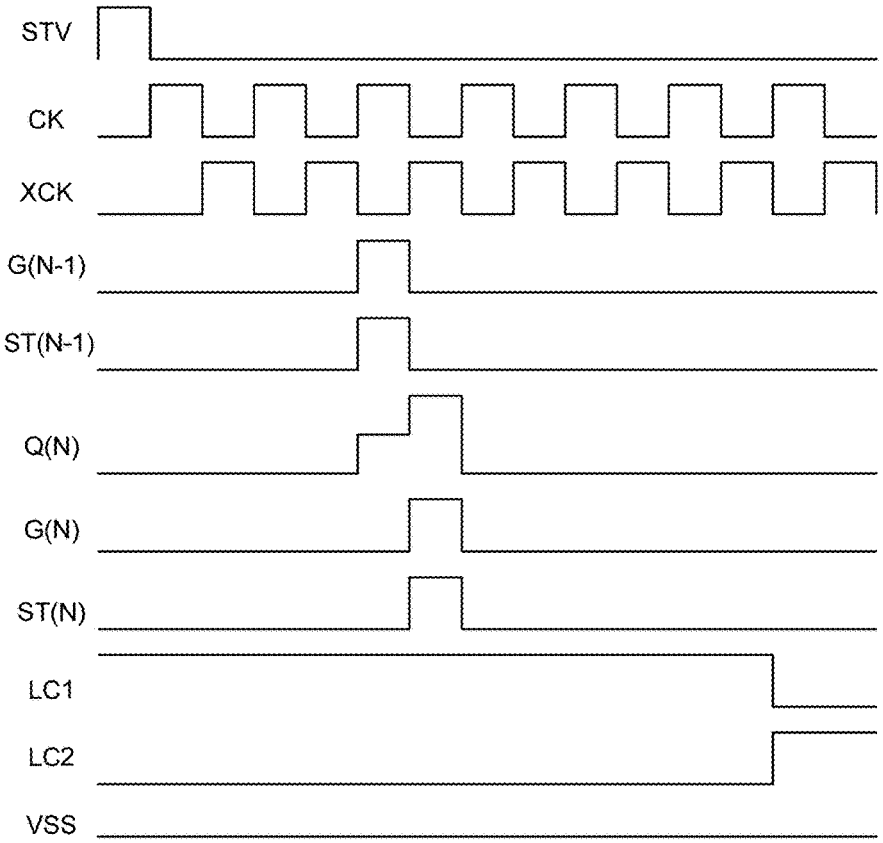
FIG. 3 schematically shows signal waveforms when a GOA drive unit works according to an embodiment of the present disclosure.

FIG. 3 gives waveform graphs of various signals of the $N^{th}$-level drive unit. When multiple levels of drive units are cascaded to form a GOA drive circuit, to reduce a load on the GOA drive circuit and improve a drive capability, multiple scanning clock signals are generally applied for joint driving. In the embodiment of FIG. 3, two scanning clock signals CK and XCK are used as examples for description. CK and XCK have an equal frequency and reverse phases, and are input, by means of interlacing, into a clock signal input end of a pull-up part 220 of each GOA drive unit. It should be noted that, the clock signal CK is not shown in FIG. 2. CK is connected to the $(N-1)^{th}$-level drive unit.

STV is a gate scanning trigger signal of the GOA drive circuit and acts on a first-level drive unit of the GOA drive circuit. In a high level period of a specific CK clock signal, the $(N-1)^{th}$-level drive unit outputs the valid gate scanning signal G (N−1) and the download signal ST (N−1). The pull-up control transistor T11 of the $N^{th}$-level drive unit starts, and the scanning control signal Q (N) reaches a first voltage value. The first voltage value can start the pull-up transistor T21 and the download transistor T22 of the $N^{th}$-level drive unit.

After T21 and T22 start, when a high level of the XCK clock signal is reached, the gate scanning signal G (N) and the download signal ST (N) output the high level of XCK at the same time. At the same time when performing gate scanning on pixels at the $N^{th}$ gate, the pull-up control transistor of the $(N+1)^{th}$-level drive unit receives the high level of G (N) and ST (N). After the gate scanning signal G (N+1) at the next gate becomes a high level, the pull-down transistors T31 and T41 of the $N^{th}$-level drive unit start, and G (N) and Q (N) are further pulled down to a low level, so as to disable the scanning on the pixels at the $N^{th}$ gate. After G (N+1) returns to a low level, the low level of G (N) and Q (N) is held by the pull-down holding part 250.

When Q (N) is a high level, the pull-down holding part 250 does not start any pull-down transistors (T42, T43, T32, and T33), so as to ensure normal scanning of the drive unit. When Q (N) is the low level, the mirrored circuit structure on one side starts to maintain the low level of G (N) and Q (N).

The pull-down holding part 150 in the prior art is shown in FIG. 1, making LC1 a high level and LC2 a low level. When Q (N) is the high level, T52 and T62 start. Because T52 starts, a voltage at the gate electrode of T53 (that is, the source of T51) is pulled down. Under an affect of the high level of LC1, T51 starts. After T51 starts, the voltage at the gate electrode of T53 is adjusted to a divided voltage of an on resistance of T51 and T52 when a voltage difference is LC1−VSS. The voltage at the gate electrode of T53 rises and may rise until T53 starts.

On the other side, under an effect of LC1 and LC2, T64 starts. After T64 starts, a potential of the K (N) point is pulled down, and therefore T55 starts. In a case in which T53, T55, and T64 all start, potentials of P (N) and K (N) are divided voltages of an on resistance of the three transistors T53, T55, and T64 when a voltage difference is LC1−LC2, and a potential of the P (N) point is higher than a potential of the K (N) point. Therefore, the potentials of P (N) and K (N) are not necessarily at a best disabled-state voltage at T42 and T32 as well as T43 and T33. As a result, a leakage current of T42 and T32 or of T43 and T33 is relatively large. In a severe case, T42 and T32 may start, so that a maintaining capability of Q (N) is insufficient, thereby affecting an output signal. Especially for a GOA drive circuit with a large-sized panel, to reduce a load on the drive circuit, transmission of a 1-to-3 or 1-to-4 signal or the like may be designed. This requires that the Q (N) point maintain an enabled state for a time ranging from 3 to 4 gates, and there is a higher requirement on a maintaining capability of the Q (N) point.

The pull-down holding part 250 in this embodiment of the present disclosure solves the foregoing problem. As shown in FIG. 2, when Q (N) is the high level, T56 and T66 also start at the same time. After starting, T56 pulls down the potential of the P (N) point down to a low voltage. After starting, T66 pulls down the potential of the K (N) point to a low voltage. In this way, T42 and T43 as well as T32 and T33 are in a reliable disabled state to ensure an output, thereby improving the maintaining capability of the Q (N) point. In this case, even if T53 starts under a divided voltage of T51 and T52, the potential of the P (N) point may be still pulled down to a relatively low potential under an effect of T56, the potential of the K (N) point may be still pulled down to a relatively low potential under an effect of T66, that is, the potentials of the P (N) point and the K (N) point are not determined only by divided voltages of T53, T55, and T64. In this embodiment, reliability of the GOA drive circuit can be significantly increased.

In this embodiment of the present disclosure, the P (N) point and the K (N) point are pulled down to a same low potential. Therefore, the pull-down potential may be designed as the best disabled-state voltage of T42 and T32 as well as T43 and T33, thereby reducing the leakage current thereof to a maximum extent and ensuring the potential maintaining capability of the Q (N) point thereof.

Figure 4:
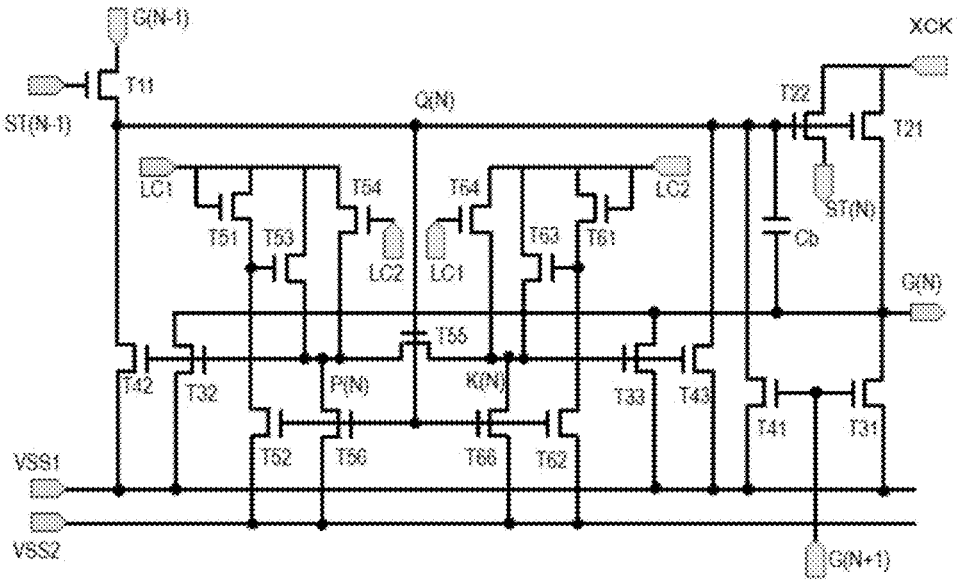
FIG. 4 schematically shows a structure of a GOA drive unit according to another embodiment of the present disclosure.

In another embodiment, sources of the pull-down transistors T56 and T66 may be coupled at a second pull-down voltage that is different from the first pull-down voltage, as shown in FIG. 4. T42 and T43 as well as T32 and T33 are still coupled at the original first pull-down voltage (which is indicated by VSS1 in FIG. 4). T52 and T62 as well as T56 and T66 are coupled at the second pull-down voltage VSS2. By adjusting a signal voltage value of VSS2, the potentials of P (N) and K (N) are pulled down to a lower level at the same time. When a designed and produced liquid crystal panel does not pass requirements, such as dependability verification, due to a reason such as a process variation, voltage values of VSS1 and VSS2 may be adjusted again to perform design again. That is, the liquid crystal panel can meet a test requirement merely by means of adjustment on a PCB circuit broad, without the need of designing a GOA circuit again. Therefore, in this embodiment, a degree of freedom of design can be increased, and a self-adjustment capability of a GOA circuit can be increased to a larger extent.

The GOA drive unit in this embodiment of the present disclosure has a relatively strong self-repair capability. Specific manifestation lies in that, when the bridge transistor T55 undergoes an open circuit or a short circuit, the drive unit can still work properly to complete a designed function. Description is made below in conjunction with FIG. 5*a* and FIG. 5*b*.

Figure 5A:
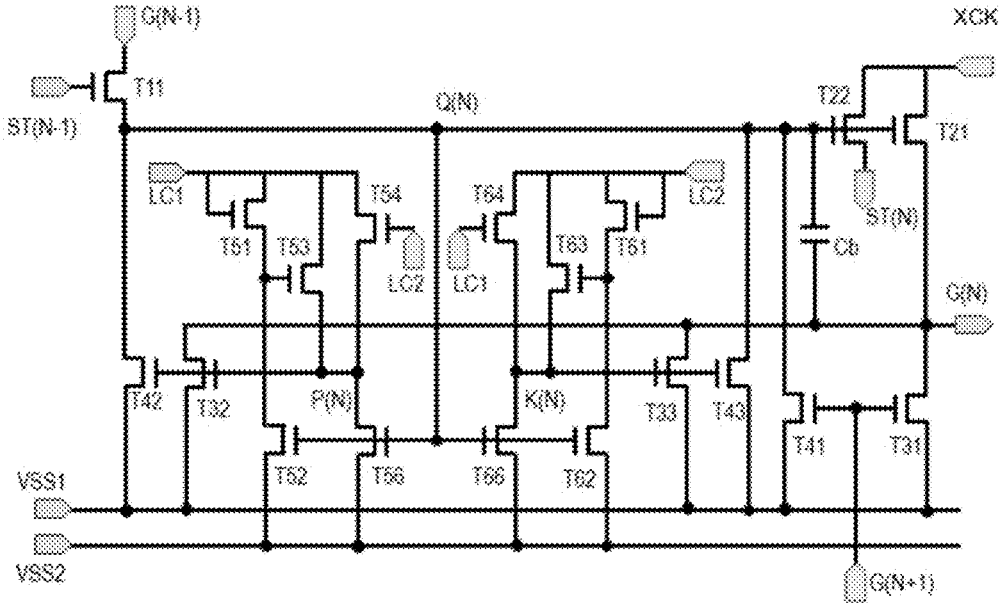
FIG. 5*a* and FIG. 5*b* schematically show circuit structures when a bridge transistor T55 undergoes an open circuit and a short circuit respectively.

FIG. 5*a* schematically shows a circuit structure when the bridge transistor T55 undergoes an open circuit. As shown in the figure, LC1 is a high level, and LC2 is a low level. When Q (N) is a high level, T52 and T62 as well as T56 and T66 start at the same time. T56 and T66 may pull the P (N) point and the K (N) point down to a low level respectively, so that T42 and T43 as well as T32 and T33 are all in a disabled state, thereby ensuring a normal output of the drive unit. When Q (N) is a low level, T52 and T62 as well as T56 and T66 are disabled at the same time. Because T51 starts, a potential at the gate electrode of T53 gradually rises. After the potential rises to a start voltage of T53, T53 starts. The potential of the P (N) point is further pulled up to a high level. T42 and T32 start. After starting, T42 and T32 pull down high voltage values of the scanning control signal Q (N) point and the gate scanning signal G (N) point.

On the other side, T66 is disabled, and T64 is still in an enabled state. Therefore, a voltage of the K (N) point still retains at a low level after adjustment, that is, T32 and T33 are still in a disabled non-working state. It can be seen that, when the bridge transistor T55 undergoes the open circuit, the drive unit in this embodiment can still work properly, that is, has a self-repair capability.

Further, the circuit shown in FIG. 5*a* can complete a circuit function of the original embodiment. Therefore, the circuit shown in FIG. 5*a* may be directly applied as an embodiment to solve a problem of voltage instability of a critical circuit node in the GOA drive circuit. It is easily understood that, DC low voltages VSS1 and VSS2 may be further combined into one voltage VSS. Although a specific degree of freedom of design is sacrificed, cabling may be simplified.

Figure 5B:
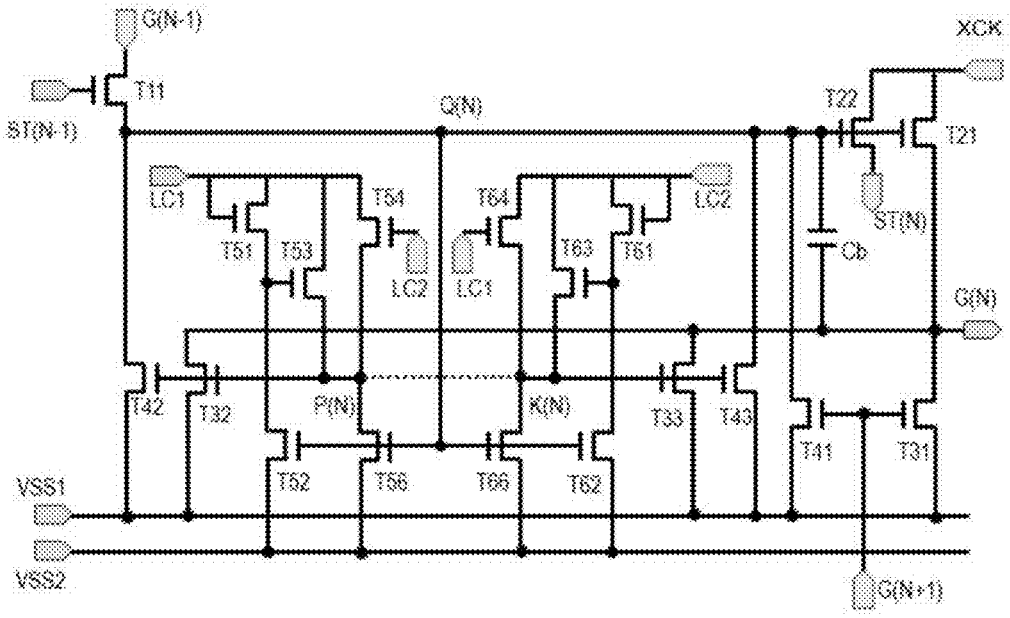
Figure 6:
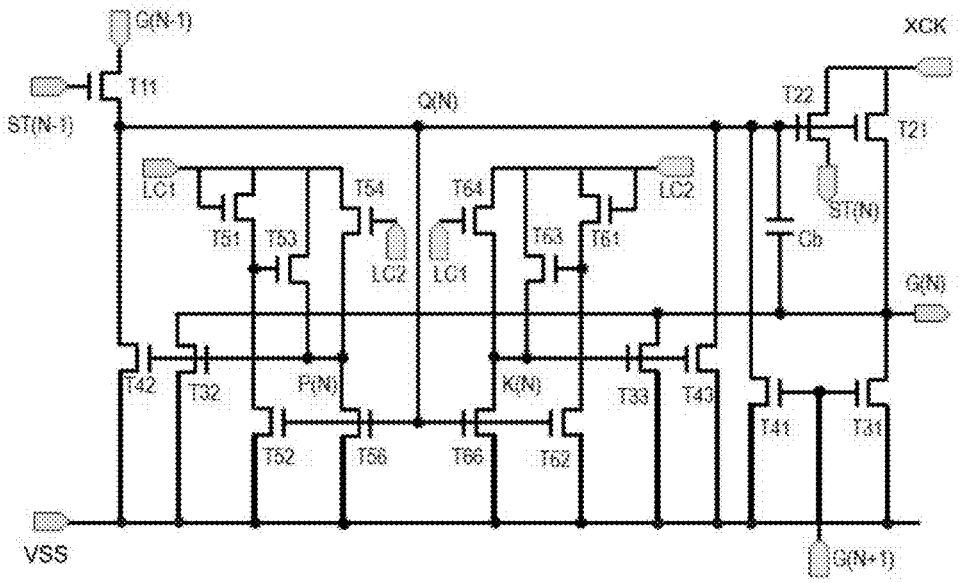
FIG. 6 schematically shows a structure of a GOA drive unit according to still another embodiment of the present disclosure.

FIG. 5*b* schematically shows a circuit structure when the bridge transistor T55 undergoes a short circuit. As shown in the figure, a dashed line in the figure indicates that T55 undergoes a short circuit. P (N) and K (N) are equivalently connected together. It can be known from an analysis process applied in FIG. 5*a* (details are not repeatedly described) that, when the drive unit in this embodiment undergoes the short circuit, the mirrored circuit structure can still complete a designed function and express a specific self-repair capability. However, the mirrored circuit structures on the left and right work at the same time, that is, do not have an alternate working capability.

According to the GOA drive unit in this embodiment of the present disclosure, by optimizing the circuit structure of the GOA drive unit, the voltage of the critical circuit node in a circuit can be reliably stabilized, whereby the signal output capability of the circuit can be improved. In addition, the GOA drive unit has a specific self-repair capability. This can further improve a GOA panel yield rate and GOA panel display quality.

Although the embodiments disclosed by the present disclosure are described above, the described contents are merely embodiments to help better understand the present disclosure instead of limiting the present disclosure. Persons skilled in the art of the present disclosure may make various modifications and variants to the implementation manners and details, without departing from the spirit and scope of the present disclosure. The scope of the present disclosure should be subject to the scope defined in the claims.

The invention claimed is:

1. A GOA drive unit, comprising a pull-up part, a pull-up control part, a key pull-down part, a pull-down holding part, and a boost capacitor, wherein:

the pull-down holding part comprises a mirrored circuit structure connected through a source and a drain that are of a bridge transistor, wherein the mirrored circuit structure comprises: a first pull-down transistor and a second pull-down transistor that are configured to maintain a low voltage at a control signal input end of the pull-up part, a third pull-down transistor and a fourth pull-down transistor that are configured to maintain a low voltage at a gate scanning signal output end of the pull-up part, a fifth pull-down transistor that is configured to maintain a low voltage at gate electrodes of the first pull-down transistor and the third pull-down transistor, and a sixth pull-down transistor that is configured to maintain a low voltage at gate electrodes of the second pull-down transistor and the fourth pull-down transistor, wherein a drain of the fifth pull-down transistor is coupled with the gate electrodes of the first pull-down transistor and the third pull-down transistor, a drain of the sixth pull-down transistor is coupled with the gate electrodes of the second pulldown transistor and the fourth pull-down transistor, gate electrodes of the fifth pulldown transistor and the sixth pull-down transistor are coupled together at the control signal input end of the pull-up part, and sources of all the pull-down transistors are coupled at a first pull-down voltage;

wherein the mirrored circuit structure further comprises a first alternate control circuit and a second alternate control circuit that are mirrored, wherein the first alternate control circuit comprises:

a seventh transistor, wherein a gate electrode and a drain of the seventh transistor are coupled together and are configured to receive a first alternate control signal;

an eighth transistor, wherein a gate electrode and a drain of the eighth transistor are coupled with a source and the drain of the seventh transistor respectively;

a ninth transistor, wherein a drain and a source of the ninth transistor are coupled with the drain and a source of the eighth transistor respectively, and the gate electrode of the ninth transistor is configured to receive a second alternate control signal; and a tenth transistor, wherein a drain of the tenth transistor is coupled with the gate of the eighth transistor, and a gate electrode and a source of the tenth transistor are coupled with a gate electrode and a source of the fifth pull-down transistor respectively; and wherein the second alternate control circuit has a mirrored structure of the first alternate control circuit, and input ends of a first alternate control signal and a second alternate control signal of the second alternate control circuit are interchanged; and the first alternate control signal and the second alternate control signal are high and low alternately.

2. The GOA drive unit according to claim 1 wherein the sources of the fifth pull-down transistor and the sixth pull-down transistor are coupled at a second pull-down voltage, wherein the second pull-down voltage is less than the first pull-down voltage.

3. The GOA drive unit according to claim 1 wherein drains of the first pull-down transistor and the second pull-down transistor are coupled together at the control signal input end of the pull-up part, and drains of the third pull-down transistor and the fourth pull-down transistor are coupled together at the gate scanning signal output end of the pull-up part.

4. The GOA drive unit according to claim 1, wherein a frequency of the alternate control signal is less than a frequency of a scanning clock signal of the GOA drive unit.

5. The GOA drive unit according to claim 1, further comprising a download element, wherein the download element comprises a download transistor, wherein a gate electrode of the download transistor is coupled with the control signal input end of the pull-up part, a drain of the download transistor is coupled with a clock signal input end of the pull-up part, and a source of the download transistor is configured to generate a download signal that acts on a next-level GOA drive unit.

6. A GOA drive circuit formed by a GOA drive unit by cascading, wherein:

the GOA drive unit comprises a pull-up part, a pull-up control part, a key pull-down part, a pull-down holding part, and a boost capacitor, wherein the pull-down holding part comprises a mirrored circuit structure connected through a source and a drain that are of a bridge transistor, wherein the mirrored circuit structure comprises: a first pull-down transistor and a second pull-down transistor that are configured to maintain a low voltage at a control signal input end of the pull-up part, a third pull-down transistor and a fourth pull-down transistor that are configured to maintain a low voltage at a gate scanning signal output end of the pull-up part, a fifth pull-down transistor that is configured to maintain a low voltage at gate electrodes of the first pull-down transistor and the third pull-down transistor, and a sixth pull-down transistor that is configured to maintain a low voltage at gate electrodes of the second pull-down transistor and the fourth pull-down transistor, wherein a drain of the fifth pull-down transistor is coupled with the gate electrodes of the first pull-down transistor and the third pull-down transistor, a drain of the sixth pull-down transistor is coupled with the gate electrodes of the second pulldown transistor and the fourth pull-down transistor, gate electrodes of the fifth pulldown transistor and the sixth pull-down transistor are coupled together at the control signal input end of the pull-up part, and sources of all the pull-down transistors are coupled at a first pull-down voltage;

wherein the mirrored circuit structure further comprises a first alternate control circuit and a second alternate control circuit that are mirrored, wherein the first alternate control circuit comprises:

a seventh transistor, wherein a gate electrode and a drain of the seventh transistor are coupled together and are configured to receive a first alternate control signal;

an eighth transistor, wherein a gate electrode and a drain of the eighth transistor are coupled with a source and the drain of the seventh transistor respectively;

a ninth transistor, wherein a drain and a source of the ninth transistor are coupled with the drain and a source of the eighth transistor respectively, and the gate electrode of the ninth transistor is configured to receive a second alternate control signal; and a tenth transistor, wherein a drain of the tenth transistor is coupled with the gate of the eighth transistor, and a gate electrode and a source of the tenth transistor are coupled with a gate electrode and a source of the fifth pull-down transistor respectively; and wherein the second alternate control circuit has a mirrored structure of the first alternate control circuit, and input ends of a first alternate control signal and a second alternate control signal of the second alternate control circuit are interchanged; and the first alternate control signal and the second alternate control signal are high and low alternately, the GOA drive unit further comprises a download element, wherein the download element comprises a download transistor, wherein a gate electrode of the download transistor is coupled with the control signal input end of the pull-up part, a drain of the download transistor is coupled with a clock signal input end of the pull-up part, and a source of the download transistor is configured to generate a download signal that acts on a next-level GOA drive unit; and the GOA drive circuit inputs, into each GOA drive unit by means of interlacing, two scanning clock signals that have an equal frequency and reverse phases.

7. A GOA drive unit, comprising a pull-up part, a pull-up control part, a key pull-down part, a pull-down holding part, and a boost capacitor, wherein the pull-down holding part comprises a mirrored circuit structure, wherein the mirrored circuit structure comprises: a first pull-down transistor and a second pull-down transistor that are configured to maintain a low voltage at a control signal input end of the pull-up part, a third pull-down transistor and a fourth pull-down transistor that are configured to maintain a low voltage at a gate scanning signal output end of the pull-up part, a fifth pull-down transistor that is configured to maintain a low voltage at gate electrodes of the first pull-down transistor and the third pull-down transistor, and a sixth pull-down transistor that is configured to maintain a low voltage at gate electrodes of the second pull-down transistor and the fourth pull-down transistor, wherein a drain of the fifth pull-down transistor is coupled with the gate electrodes of the first pull-down transistor and the third pull-down transistor, a drain of the sixth pull-down transistor is coupled with the gate electrodes of the second pulldown transistor and the fourth pull-down transistor, and gate electrodes of the fifth pull-down transistor and the sixth pull-down transistor are coupled together at the control signal input end of the pull-up part;

sources of all the pull-down transistors are coupled at a first pull-down voltage; and drains of the first pull-down transistor and the second pull-down transistor are coupled together at the control signal input end of the pull-up part, and drains of the third pull-down transistor and the fourth pull-down transistor are coupled together at the gate scanning signal output end of the pull-up part; and the mirrored circuit structure further comprises a first alternate control circuit and a second alternate control circuit that are mirrored, wherein the first alternate control circuit comprises:

a seventh transistor, wherein a gate electrode and a drain of the seventh transistor are coupled together and are configured to receive a first alternate control signal;

an eighth transistor, wherein a gate electrode and a drain of the eighth transistor are coupled with a source and the drain of the seventh transistor respectively;

a ninth transistor, wherein a drain and a source of the ninth transistor are coupled with the drain and a source of the eighth transistor respectively, and a gate electrode of the ninth transistor is configured to receive a second alternate control signal; and a tenth transistor, wherein a drain of the tenth transistor is coupled with the gate electrode of the eighth transistor, and a gate electrode and a source of the tenth transistor are coupled with a gate electrode and a source of the fifth pull-down transistor respectively; and the second alternate control circuit has a mirrored structure of the first alternate control circuit, and input ends of a first alternate control signal and a second alternate control signal of the second alternate control circuit are interchanged; and the first alternate control signal and the second alternate control signal are high and low alternately.

8. The GOA drive unit according to claim 7, further comprising a download element, wherein the download element comprises a download transistor, wherein a gate electrode of the download transistor is coupled with the control signal input end of the pull-up part, a drain of the download transistor is coupled with a clock signal input end of the pull-up part, and a source of the download transistor is configured to generate a download signal that acts on a next-level GOA drive unit.

* * * * *